US006233745B1

(12) United States Patent
Friesen

(10) Patent No.: US 6,233,745 B1
(45) Date of Patent: May 22, 2001

(54) HAT SUPPORTED NECK COVER OR SHADE

(76) Inventor: Lorin Dean Friesen, 357 Crest Circle Dr., San Marcos, TX (US) 78666

( * ) Notice: Subject to any disclaimer, the term of this patent is extended or adjusted under 35 U.S.C. 154(b) by 0 days.

(21) Appl. No.: 09/365,319

(22) Filed: Jul. 30, 1999

(51) Int. Cl.[7] ..... A42B 1/06
(52) U.S. Cl. ..... 2/172; 2/209.13; 2/171.2
(58) Field of Search ..... 2/172, 209.13, 2/175.3, 175.1, 174, 195.1, 175.6, 171.02, 181, 181.4, 206, 207, 171.2

(56) References Cited

U.S. PATENT DOCUMENTS

| | | | | |
|---|---|---|---|---|
| 931,463 | * | 8/1909 | McPherson | 2/172 |
| 2,007,235 | * | 7/1935 | Woodside | 2/209.13 |
| 2,230,805 | * | 2/1941 | Levy | 2/172 |
| 2,327,678 | * | 8/1943 | Stovall | 2/174 |
| 2,897,510 | | 8/1959 | Forbes-Robinson . | |
| 4,980,928 | * | 1/1991 | Ellis | 2/172 |
| 5,161,259 | * | 11/1992 | Shorts | 2/172 |
| 5,212,837 | * | 5/1993 | Gose et al. | 2/172 |
| 5,323,491 | * | 6/1994 | Barrett, Jr. | 2/172 |
| 5,355,535 | | 10/1994 | Bruder . | |
| 5,557,807 | | 9/1996 | Hujar et al. . | |
| 5,592,696 | * | 1/1997 | Oliver | 2/175.6 |
| 5,603,120 | | 2/1997 | Gifford . | |
| 5,623,732 | | 4/1997 | Olajide, Jr. . | |
| 5,649,327 | | 7/1997 | Crewe . | |
| 5,655,225 | | 8/1997 | Mathers . | |
| 5,666,668 | * | 9/1997 | Ronquillo | 2/172 |
| 5,669,074 | | 9/1997 | Newman, Jr. . | |
| 5,669,075 | | 9/1997 | Weeks . | |
| 5,887,287 | | 3/1999 | Potochnik . | |
| 5,933,871 | | 8/1999 | Kraft . | |
| 5,950,241 | * | 9/1999 | Gomez | 2/172 |

* cited by examiner

*Primary Examiner*—Amy B. Vanatta
(74) *Attorney, Agent, or Firm*—Akin, Gump, Strauss, Hauer & Feld, LLP

(57) ABSTRACT

A flexible neck cover for attachment to the lower back rim or band of a hat or cap is formed from a conical surface of revolution to provide an improved shape which allows the cover to flow or drape over a person's shoulders when wearing the neck cover. The neck cover is provided with respective upper and lower concave and convex arcuate edges and opposed, preferably straight or convex curved side edges. The neck cover may include decorative indicia thereon, including advertising information or the like, and water dispensing vials or a soaker "rope" secured thereto to provide an evaporative cooling effect for the wearer.

8 Claims, 4 Drawing Sheets

HAT SUPPORTED NECK COVER OR SHADE

FIELD OF THE INVENTION

The present invention pertains to a flexible cover attachable to a hat or cap to shade or cover the back of a person's neck and to provide a display area.

BACKGROUND

Neck sunshades or covers which are temporarily or permanently affixed to the backside of a hat or other head gear are known. However, prior art neck sunshades or hoods have not been particularly adapted to be draped properly on one's shoulders and retain a shape, when worn, which will completely cover the back of a person's neck comfortably at substantially all times. This deficiency in prior art neck sunshades is due primarily to a failure to provide the proper shape of the neck cover or shade.

Accordingly, prior art neck sunshades and the like do not drape or spread evenly across the back of the neck and remain draped over one's shoulders, particularly when worn out of doors in both calm and windy conditions and/or by persons who are undertaking vigorous physical activity. Still further, due to the lack of proper configuration of prior art sunshades or neck covers, such covers have not been suitable for displaying various indicia thereon, such as advertising information, since the shape and draping of the cover is such that the indicia cannot be viewed in its entirety while the cover is being worn. It is to overcome these deficiencies of the prior art that the present invention has been developed.

SUMMARY OF THE INVENTION

The present invention provides an improved neck sunshade or cover adapted to be permanently or temporarily affixed, preferably, to or above the rim or band of a hat or cap, which flows loosely over the wearer's ears and is operable to lie properly draped over one's shoulders and upper back to provide a suitable cover for one's neck when worn out of doors.

The present invention also provides an improved neck shade or cover which may be worn attached to the back of a cap or hat and which may have suitable indicia, such as advertising information, printed thereon and which is suitably displayed while the cover is being worn.

The improved neck cover of the invention is formed of a portion of a surface of revolution, particularly a conical surface of revolution. It has been discovered that a neck shade or cover so configured drapes itself more evenly and completely across one's shoulders, covers one's neck to protect against sunlight and chill winds and provides an improved display for indicia, including advertising or similar promotional information.

Those skilled in the art will further appreciate the important features of the present invention upon reading the detailed description which follows in conjunction with the drawing.

DETAILED DESCRIPTION OF PREFERRED EMBODIMENTS

Figure 1:
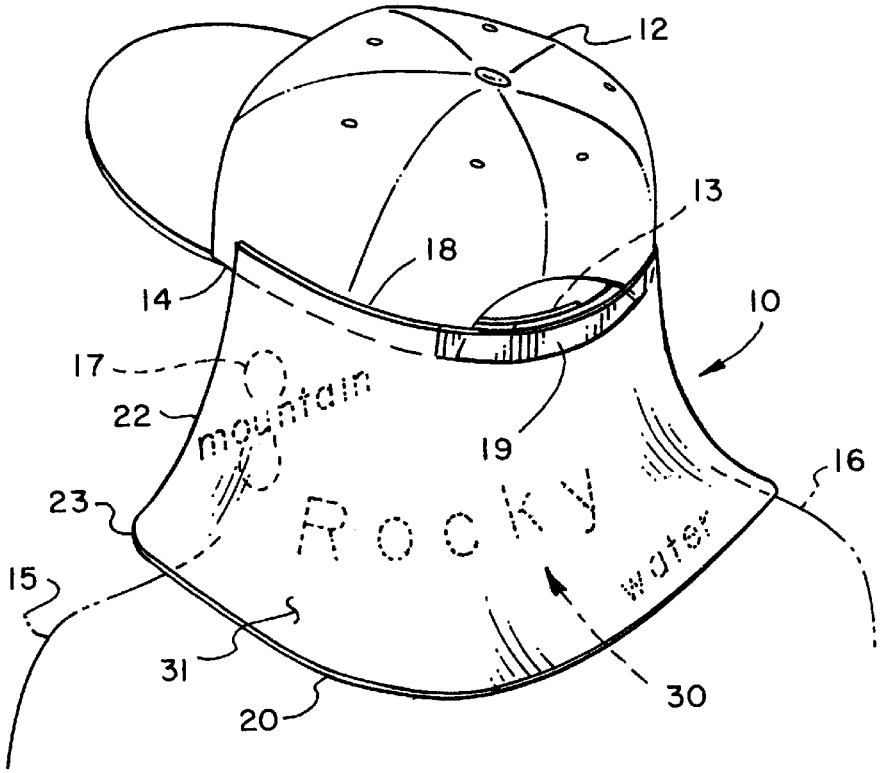
FIG. 1 is a perspective view of one preferred embodiment of the neck cover of the invention attached to a cap and shown draped over a wearer's shoulders.

In the description which follows like elements or features are marked with the same reference numerals, respectively.

Referring to FIG. 1, there is illustrated a neck cover in accordance with the present invention and generally designated by the numeral 10. The neck cover 10 is shown attached to a hat or cap 12 having a lower peripheral edge or band 14. Thanks to the unique configuration of the neck cover 10, it retains a draped enveloping shape, as shown, flowing over the shoulders 15 and 16 and covering the ears 17, one shown, of a wearer of the cap 12, as illustrated.

Figure 2:
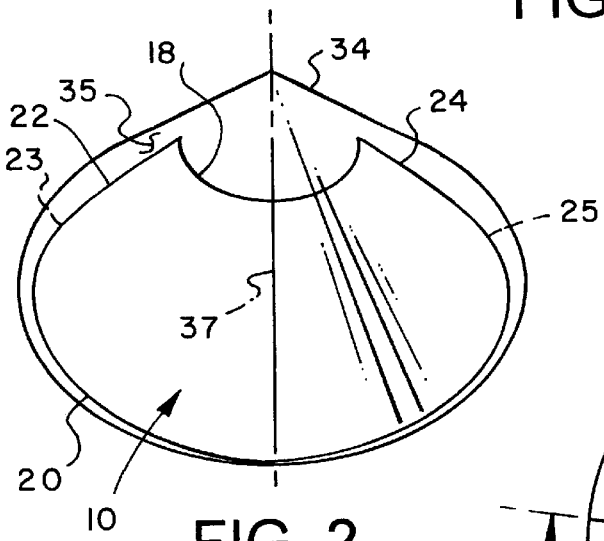
FIG. 2 is a perspective view illustrating the neck cover forming a portion of a conical surface of revolution.
Figure 3:
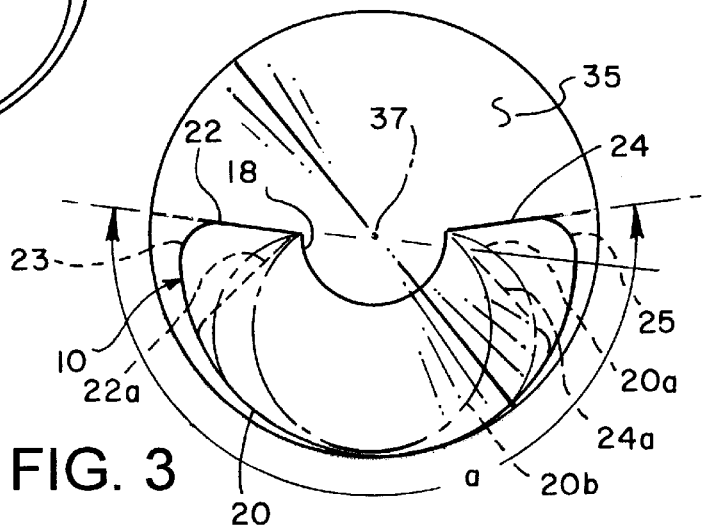
FIG. 3 is a plan view further illustrating the shape of the neck cover of the invention.

Referring further to FIG. 1, the neck cover 10 includes an arcuate, concave upper or top edge 18 spaced from an arcuate convex lower or bottom edge 20, and opposed generally straight side edges 22 and 24 which may be tapered toward each other from upper edge 18 toward lower edge 20, see FIGS. 2 and 3 also. Referring further to FIG. 1, the upper edge 18 is preferably provided with an elastic portion 19 extending at least along a part of the upper edge 18 between the intersection of the upper edge with the side edges 22 and 24. The elastic portion 19 may comprise a conventional garment elastic band which is suitably attached to the neck cover 10 within a hem, for example, at the upper edge 18. In this way, the neck cover 10 may accommodate adjustable hats or caps, such as the hat 12, which has a size adjustment belt 13, of conventional construction, provided therefor.

The neck cover 10 may be suitably connected to the cap 12 permanently, such as by sewing, or otherwise securing the edge 18 to the periphery of the cap 12 just at the lower peripheral edge or band 14. Temporary attachment means including hook and loop fasteners, "tie-tack" type fasteners, snap fasteners or releasable adhesive strips may also be provided, if desired. Thanks to the shape of the neck cover 10, various types of decorative indicia, such as advertising information 30, may be printed or otherwise provided on the outer surface 31 of the neck cover whereby neck covers according to the invention may be sold or distributed as promotional items, for example. One particular advantage of the neck cover 10 is that, due to its shape and desirable draping when worn, the entire outer surface 31 is viewable and any indicia printed thereon is also, of course, easily viewed.

Referring to FIGS. 2 and 3, there is illustrated the configuration of the neck cover 10 formed as a portion of a surface of revolution of a cone 34. As shown in FIG. 3, a preferred embodiment of the neck cover 10 is one which extends on conical surface 35 over an arc "a" of about 200° to 210° with respect to the cone axis of revolution 37. The cone 34 preferably has an included angle of about 90°. A preferred embodiment of the neck cover 10 is also provided with arcuate corners 23 and 25 formed between the side edges 22 and 24 and the bottom edge 20. Alternatively, as shown in FIG. 3, the bottom edge 20 and the side edges 22 and 24 may be formed as one continuous arcuate convex edge 20*a*. Also, the bottom edge 20 and the side edges 22 and 24 may be formed as a continuous convex circular arc 20*b* and intersecting the concave top edge 18, as shown in FIG. 3. Still further, as shown in FIG. 3, the side edges may be modified, as indicated by numerals 22*a* and 24*a*, to provide the proportions shown wherein the included angle between such side edges is about 90°.

Figure 4:
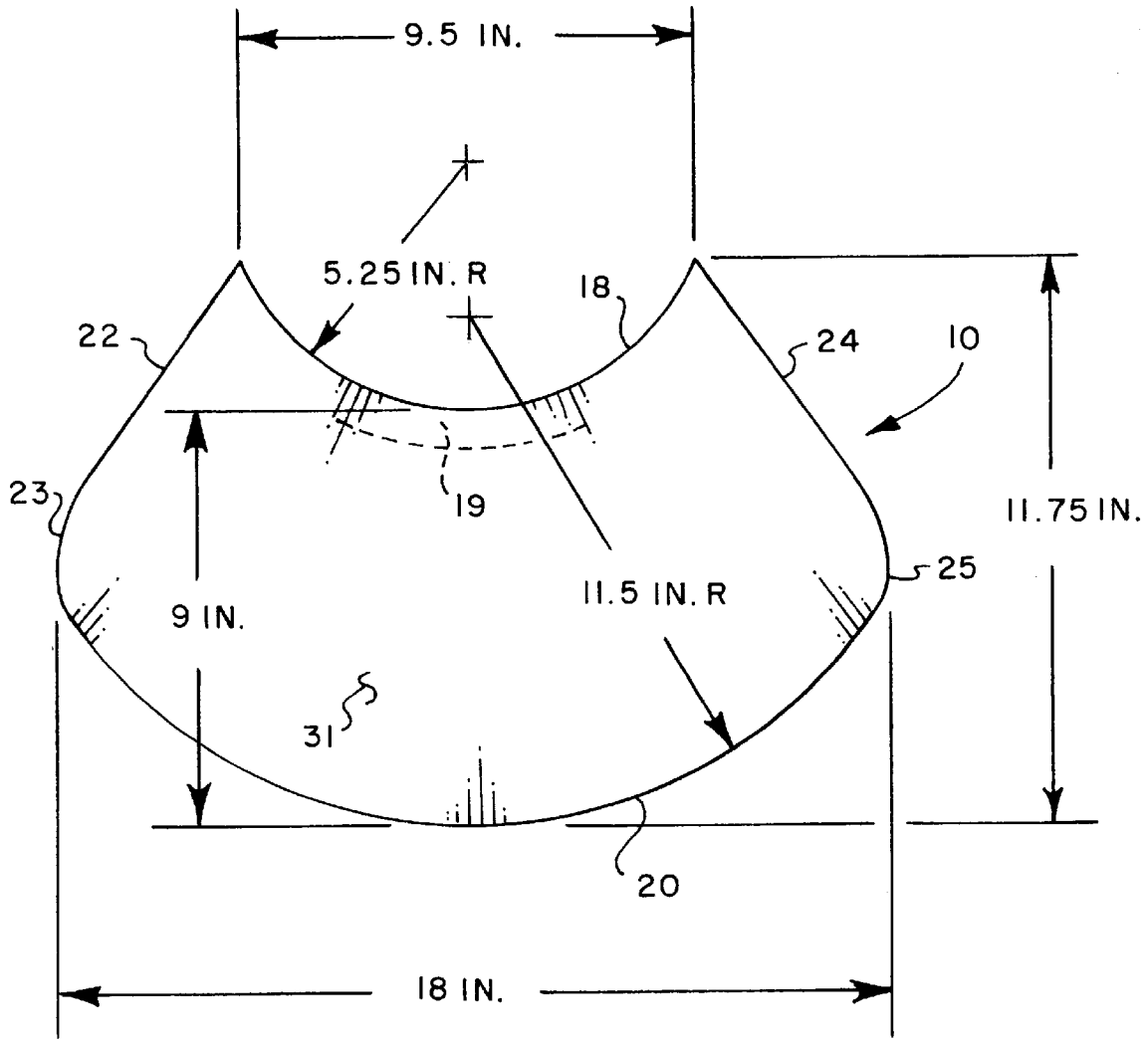
FIG. 4 is a planar developed view of the neck cover showing exemplary dimensions therefor.

Referring now to FIG. 4, there is shown a developed plan view of the neck cover 10 wherein a preferred embodiment has an arcuate upper edge 18 having a radius of curvature of about 5.25 inches and wherein the lower edge 20 has a radius of curvature of about 11.50 inches. The overall width of the neck cover 10 between corners 23 and 25 is 18.0 inches in the preferred embodiment and the overall height between the bottom edge 20 and the intersection of the side edges 22 and 24 with the upper edge 18 is about 11.75 inches. These dimensions leave a length of the neck cover 10 of about 9.0 inches, as indicated.

Figure 5:
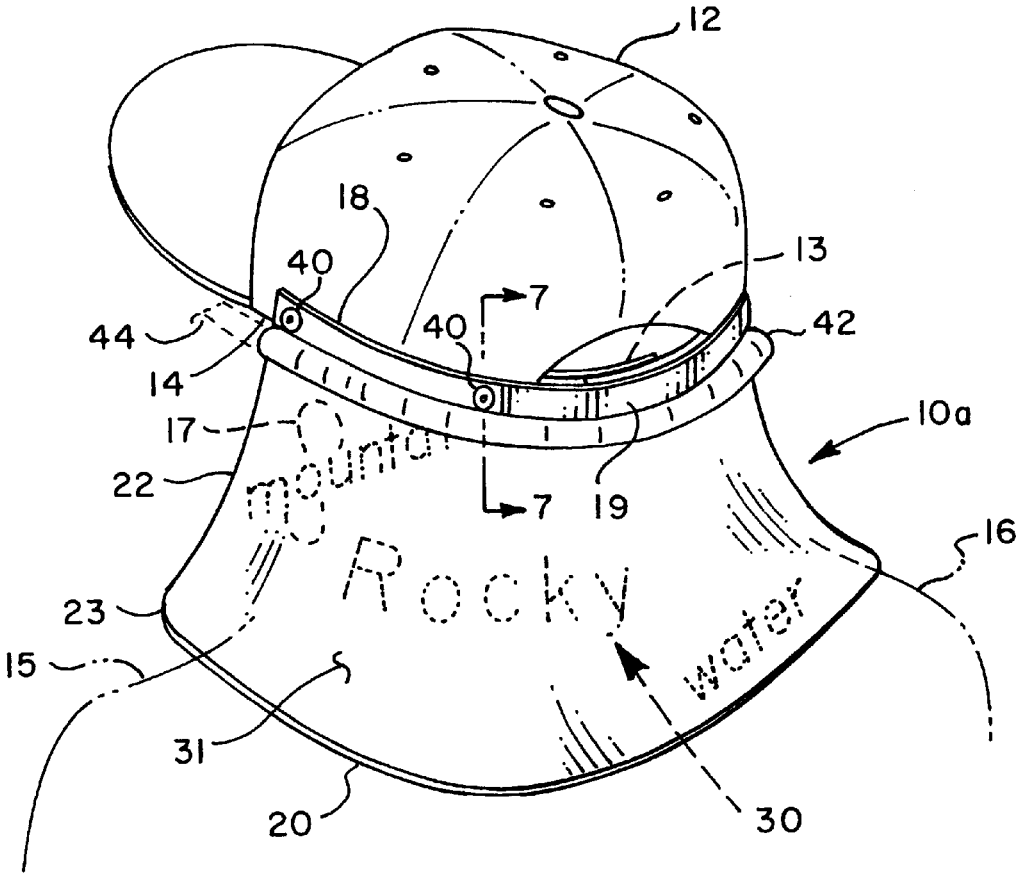
FIG. 5 is a perspective view of a first alternate embodiment of a neck cover in accordance with the invention.

Referring now to FIG. 5, a first alternate embodiment of a neck cover in accordance with the invention is shown and designated by the numeral 10*a*. The neck cover 10*a* is similar in most respects to the neck cover 10 but is shown detachably connected to a cap 12 by spaced apart snap fasteners 40. Two snap fasteners 40 are shown spaced apart for attaching the neck cover 10*a* at the upper edge 18 to the cap 12. Additional fasteners 40, not shown, may be suitably spaced apart along the right side of the neck cover 10*a* also.

Figure 7:
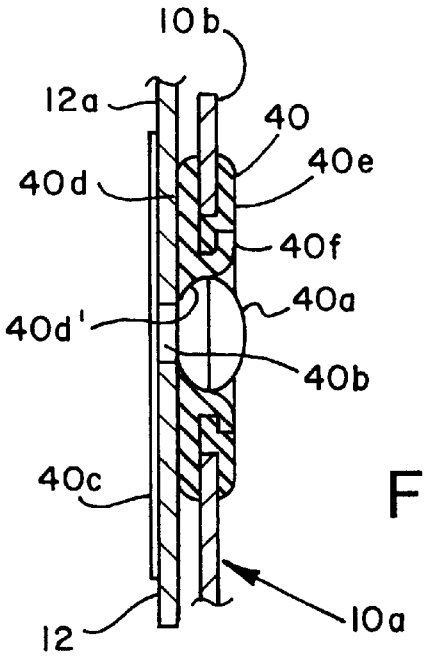
FIG. 7 is a detail section view taken generally along line 7—7 of FIG. 5.

The fasteners 40 may be of a conventional design but are, preferably, of a type indicated in FIG. 7 wherein each fastener 40 is characterized by a snap member 40*a* connected to a reduced diameter hub portion 40*b* which is integrally formed with a generally circular, relatively thin disk-like base part 40*c*. The snap member 40*a* and hub 40*b* project through a suitable opening in the fabric layer 12*a* of cap 12, as shown. The snap fastener 40 is also characterized by a grommet comprising opposed disc members 40*d* and 40*e*. Disc member 40*d* has a suitable generally cylindrical opening 40*d*[1] formed therein and a circumferential retaining flange 40*f* which is suitably displaced radially outwardly to engage the grommet member 40*e* to retain it in assembly with the grommet member 40*d*. Grommet members 40*d* and 40*e* are assembled through a suitable opening in the fabric of cover 10*a* and crimped together by displacement of the flange 40*f* trapping the fabric layer 10*b* between grommet members 40*d* and 40*e*.

The neck cover 10*a* includes an additional feature which is advantageous comprising an evaporative cooling water dispensing device characterized by an elongated fibrous rope member 42 extending substantially parallel to and spaced from the upper edge 18 and suitably secured to the neck cover 10*a*. Alternatively, the evaporative cooling water dispensing rope 42 may be worn by securing the rope with a suitable headband 44, a portion of which is shown in FIG. 5. Accordingly, the neck cover 10*a* may be detached from the cap 12 and a suitable amount of cooling water may be applied to the cooling water dispensing rope 42 to "soak" the rope prior to donning the neck cover when reattached to the cap 12. By providing the cooling water dispensing rope 42, cooling water absorbed thereunto may wick down through the fabric of the neck cover 10*a* toward the lower edge 20 to provide an evaporative cooling effect to the wearer's neck.

Figure 6:
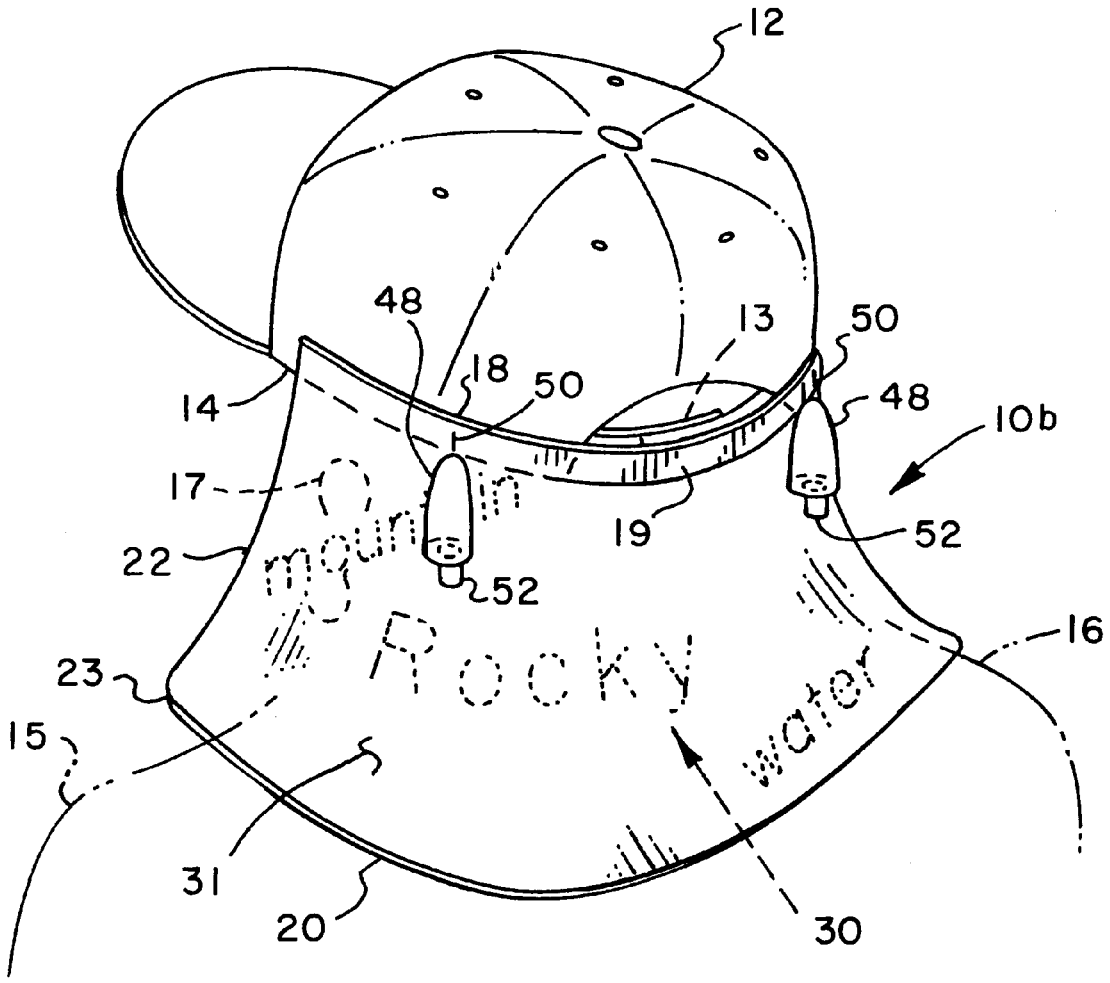
FIG. 6 is a perspective view of a second alternate embodiment of a neck cover in accordance with the invention.

Referring now to FIG. 6, a second alternate embodiment of a neck cover in accordance with the invention is illustrated and generally designated by the numeral 10*b*. The neck cover 10*b* is similar in most respects to the neck covers 10 and 10*a* and may be attached to a cap 12 by any one of the means described above. Additionally, the neck cover 10*b* is provided with spaced apart cooling water dispensing vials 48 which are each suitably secured at one end adjacent the upper edge 18 by conventional tether means 50. The cooling water dispensing vials 48 have water dispensing nozzles 52 extending therefrom and which are operable to meter and sprinkle cooling water onto the fabric of the neck cover 10 *b* as a consequence of the wearer's head motion to also provide a cooling effect through evaporation.

The neck cover 10 may be fabricated of one of several materials, including woven or knit cotton or synthetic fabrics. Indicia, such as the advertising indicia 30, may be printed on the surface 31 using conventional methods.

Although preferred embodiments of a neck cover or skirt have been described herein, those skilled in the art will recognize that various substitutions and modifications may be made to the invention without departing from the scope and spirit of the appended claims.

What is claimed is:

1. A neck cover for attachment to a lower peripheral edge of a cap to cover and shade a person's neck, said neck cover being formed of a flexible fabric and initially as a portion of a conical surface of revolution, said neck cover including a concave upper edge formed substantially as an arc of a circle, a convex lower edge formed substantially as an arc of a circle and opposed side edges, said opposed side edges delimiting an arc with respect to a central axis of revolution of said conical surface of revolution in a range of about 90° to 210°, and plural fasteners spaced apart adjacent said upper edge for attaching said neck cover to said cap.

2. The neck cover set forth in claim 1 including:

an elastic portion attached to said neck cover at said upper edge between said side edges.

3. The neck cover set forth in claim 1 including:

indicia printed on an outer surface of said neck cover between said edges.

4. The neck cover set forth in claim 1 including:

evaporative coolant dispensing means connected to said neck cover adjacent an upper edge of said neck cover.

5. The neck cover set forth in claim 4 wherein:

said coolant dispensing means comprises a fibrous rope secured to said neck cover adjacent said upper edge.

6. The neck cover set forth in claim 4 wherein:

said coolant dispensing means comprises at least one coolant vial having a dispensing nozzle for dispensing coolant onto said neck cover.

7. The neck cover set forth in claim 1 wherein:

said fasteners comprise a plurality of snap fasteners spaced apart adjacent said upper edge of said neck cover, said snap fasteners each being characterized by a snap member comprising a hub portion and a backing member, said snap member being engageable with a grommet for releasably securing said neck cover to said cap.

8. A neck cover for attachment to a lower peripheral edge of a cap to cover and shade a person's neck, said neck cover being formed of a flexible fabric and initially as a portion of a conical surface of revolution, said neck cover including a concave upper edge, a convex lower edge and opposed side edges, said opposed side edges delimiting an arc with respect to a central axis of revolution of said conical surface of revolution in a range of about 90° to 210°, and plural fasteners spaced apart adjacent said upper edge for attaching said neck cover to said cap, said fasteners comprising a plurality of snap fasteners spaced apart adjacent said upper edge of said neck cover, said snap fasteners each being characterized by a snap member comprising a hub portion and a backing member, said snap member being engageable with a grommet connected to said neck cover for releasably securing said neck cover to said cap.

* * * * *